US007721744B2

(12) United States Patent
Sabater Vilella

(10) Patent No.: US 7,721,744 B2
(45) Date of Patent: May 25, 2010

(54) MACHINE FOR CONDITIONING PAPER PRINTED BY MEANS OF DIGITAL PRINTING SYSTEMS

(75) Inventor: Jordi Sabater Vilella, Sant Cugat Del Valles (ES)

(73) Assignee: Digital Internet Transport System, S.L., Sant Cugat Del Valles (Barcelona) (ES)

( * ) Notice: Subject to any disclaimer, the term of this patent is extended or adjusted under 35 U.S.C. 154(b) by 1104 days.

(21) Appl. No.: 11/282,104

(22) Filed: Nov. 16, 2005

(65) Prior Publication Data

US 2006/0099020 A1 May 11, 2006

Related U.S. Application Data

(63) Continuation of application No. PCT/ES2004/000219, filed on May 18, 2004.

(30) Foreign Application Priority Data

May 19, 2003 (ES) ..... 200301258
May 14, 2004 (ES) ..... 200401166

(51) Int. Cl.
*B08B 3/04* (2006.01)

(52) U.S. Cl. ..... 134/49

(58) Field of Classification Search ..... 134/49
See application file for complete search history.

(56) References Cited

U.S. PATENT DOCUMENTS

| | | | | |
|---|---|---|---|---|
| 2,063,672 | A * | 12/1936 | Goddard | 101/147 |
| 3,686,771 | A | 8/1972 | Schone et al. | |
| 4,388,864 | A * | 6/1983 | Warner | 101/148 |
| 4,415,610 | A * | 11/1983 | Choinski | 427/372.2 |
| 4,713,128 | A * | 12/1987 | Kerwin | 156/64 |
| 5,040,911 | A * | 8/1991 | Sanders et al. | 400/618 |
| 5,189,960 | A * | 3/1993 | Valentini et al. | 101/487 |
| 2002/0182487 | A1 * | 12/2002 | Wirtz | 429/130 |

FOREIGN PATENT DOCUMENTS

| | | |
|---|---|---|
| ES | 2 100 592 T3 | 6/1997 |
| FR | 769361 | 8/1934 |
| GB | 429210 A | 5/1935 |

* cited by examiner

*Primary Examiner*—Frankie L Stinson
*Assistant Examiner*—Samuel A Waldbaum
(74) *Attorney, Agent, or Firm*—Leason Ellis LLP

(57) ABSTRACT

The process comprises the creation of a surface moistened on one of the faces of the paper by natural condensation droplets created by refrigerating said laminar support on the opposite face, adapting the continuous web of printed paper on said surface in a zone of variable tangency to achieve regular and uniform remoistening of the web of paper.

19 Claims, 17 Drawing Sheets

MACHINE FOR CONDITIONING PAPER PRINTED BY MEANS OF DIGITAL PRINTING SYSTEMS

CROSS REFERENCE TO PRIOR APPLICATION

This application is a continuation of International Patent Application No. PCT/ES2004/000219, filed May 18, 2004, and claims benefit of Spanish Patent Application No. 200301258, filed May 19, 2003, and Spanish Patent Application No. P200401166, filed May 14, 2004, which are incorporated by reference herein. The International Application was published in Spanish on Nov. 25, 2004 as WO 2004/101281 A1 under PCT Article 21(2).

The present invention relates to a process and the corresponding apparatus for conditioning paper printed by means of digital printing systems that has substantial novelty and inventive step.

At present a growing number of digital printing systems are being installed based on various technologies that use both continuous rolls of paper and cut sheets, and can reach high print speeds, close to those of traditional printing systems.

A typical characteristic of many digital printing systems is the generation of heat in substantial proportions, heating the paper and causing variations in the ideal moisture conditions that the paper should have if it is to behave correctly throughout the printing and subsequent handling processes.

This problem particularly affects systems for processing the paper once it has been printed, in other words, mechanised cutting, folding and classification systems, so that completed jobs such as a book, for example, can be achieved. In this type of finishing machine, the loss of moisture in the paper resulting from the relatively high heating to which the paper has been subjected on being printed substantially influences the behaviour of the paper in subsequent processes, often causing operational disturbances.

To try to solve this problem, processes and machines have been disclosed intending to replace the moisture lost by the paper by means of systems for spraying or atomising water on the paper after it has passed through the printing phases. However these processes have substantial irregularity defects, since the film of water sprayed directly onto the paper cannot give uniform moistening over its whole surface.

The object of the present invention is precisely to solve the aforementioned problem and the inventor, after extensive trials and tests, has achieved a process for conditioning paper printed by means of digital systems that compensates for the loss of moisture produced by heating in the process itself. Said process is based on the arrangement of a surface on which condensation is created from atmospheric moisture by cooling one of its faces, while the printed paper produced by digital printing machines slides with adjustable contact on the other face. Preferably the sliding surface for the paper is metallic and in a preferred embodiment consists of the surface of one or more cylindrical drums of which the inner part is connected to a conventional refrigeration system and of which the outer surface comes into contact with the paper that is sliding over said drum, in such a way that the thin film of surface moisture produced by condensation of atmospheric moisture on the outer surface of the drum that is refrigerated inside, is sufficient to remoisten the paper uniformly and regularly. As will be understood, the method will be combined with a check of the moisture of the paper when it leaves the remoistening process, in order to adjust the internal refrigeration of the drum, taking account of the ambient humidity and the moisture of the paper itself. The process will therefore generally comprise detection of the moisture of the paper, adjusting the refrigeration characteristics of the exchange surface, preferably a drum, varying the contact area between the paper and the refrigerated drum and, if necessary, the exit speed, to achieve optimum adjustment of the moisture of the paper. In an integrated manner the degree of moisture of the paper when it leaves the conditioning process will also be detected to compare it with the optimum values previously determined, adjusting the process parameters in order to achieve the desired remoistening characteristics.

The present invention also relates to apparatus designed to produce the remoistening process of the present invention. Said apparatus basically comprises one, two or more hollow metallic drums with internal refrigeration means and subjected to the air of the atmosphere, so that a light film of condensation droplets is deposited on the outer surface of each of the drums, the machine having appropriate means to cause the paper to touch the surface of the drums in an area of coincidence suited to the needs of the process, so that the area will be greater if remoistening needs to be more intense, and smaller if said remoistening can be less. If the machine stops operating, the paper will cease to make touching contact with the drums of the machine, in order to avoid spot effects that can damage the operation of the machine.

The present invention also relates to the provision of a system of rollers to accompany the paper sheeting that needs to be treated inside the conditioning chamber. For the purposes of greater simplicity and efficacy, provision is made for a system to be used that, as a minimum, will comprise a set of three rollers with horizontal axes, two of which are fixed and separated by a determined distance and a third arranged in an intermediate position and with the capacity to be adjusted up or down, in such a way that the paper sheet coincides partly on the periphery of the two outer fixed rollers and on the periphery of the central movable roller. The contact zone will vary depending on the vertical position of said intermediate roller and therefore the conditioning action can also vary.

Thus, the intermediate conditioning roller will have different relative positions as will the two fixed outer rollers from a rest position, passing through a minimum separation position with regard to the paper sheeting and reaching positions of greater or lesser coincidence with the periphery of the intermediate roller up to a maximum down position of said intermediate roller, which will coincide with the area of maximum coincidence of the paper sheeting with the periphery of the conditioning roller.

The present improvements relate to a process and corresponding machine for conditioning paper printed by means of digital printing systems that will be combined with any kind of digital electronic printing copying machine.

To understand it better, the accompanying drawings, which are given as an explanatory and non-limiting example, illustrate an embodiment of the machine according to the present invention adapted for use with continuous paper that also allows the characteristics of the process to be understood.

Figure 1:
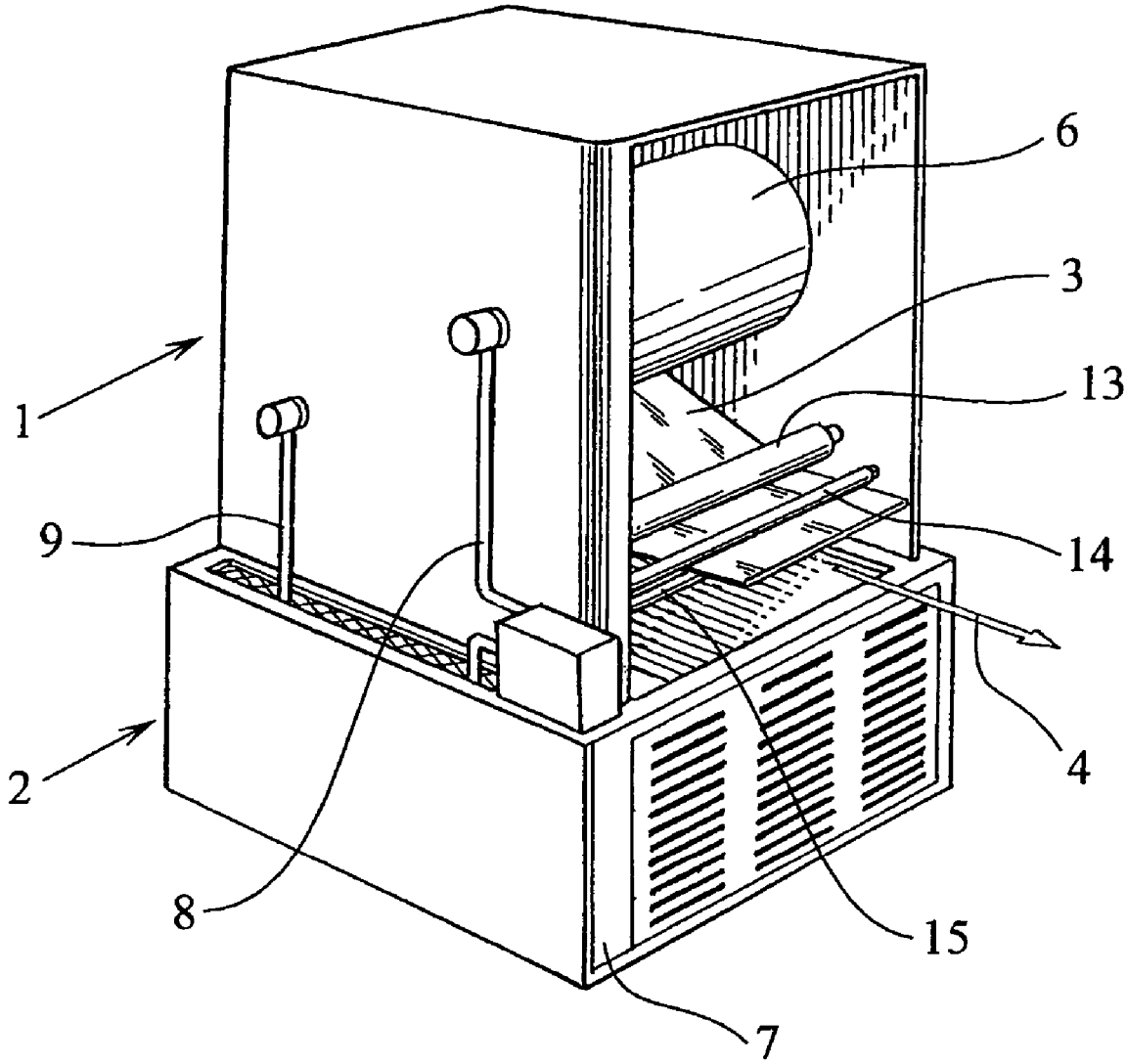
FIG. 1 shows a view in perspective of a machine produced in accordance with the present invention.
Figure 2:
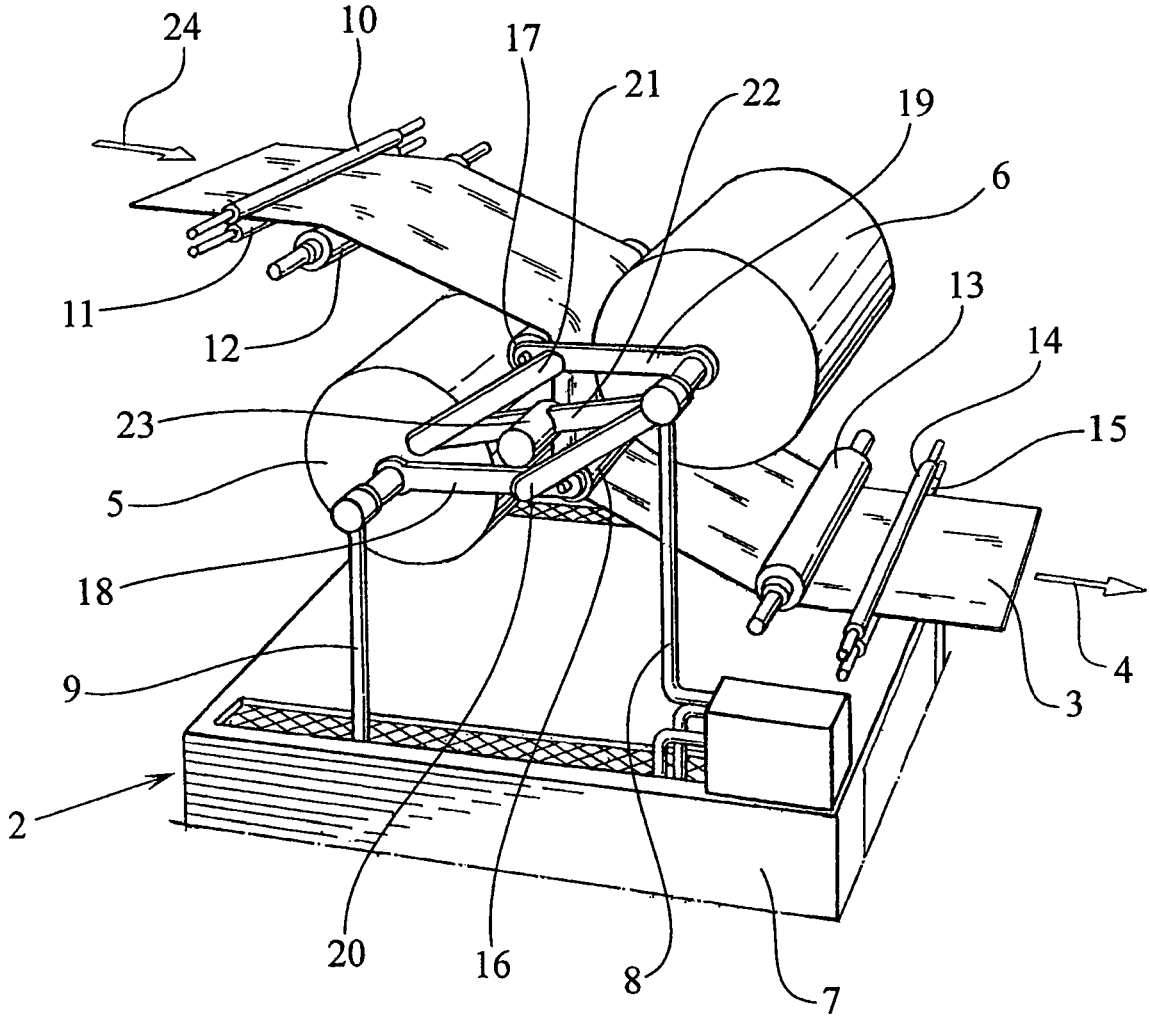
FIGS. 2 and 3 show in perspective and diagrammatically the components of the machine of FIG. 1.
Figure 3:
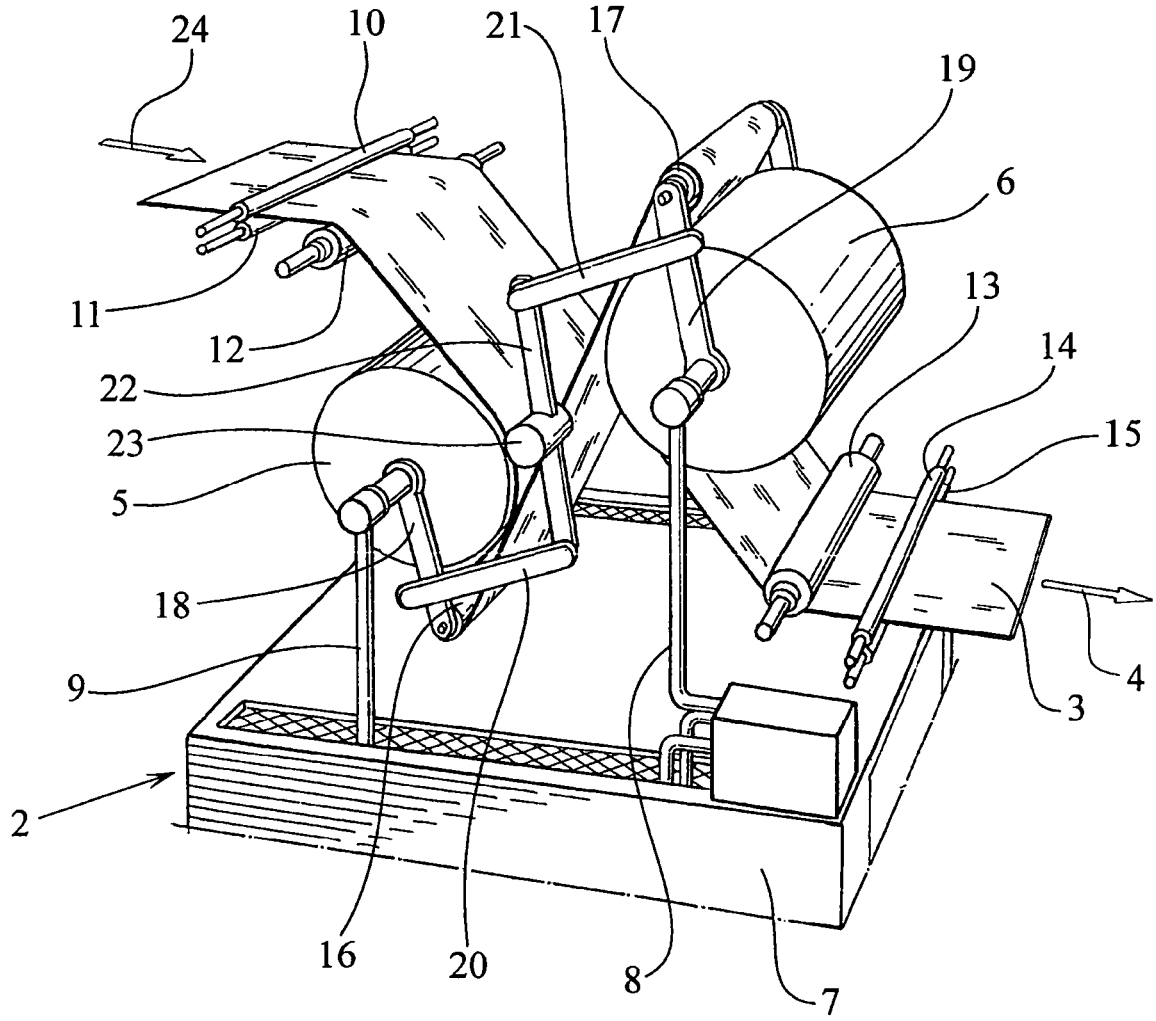
Figure 4:
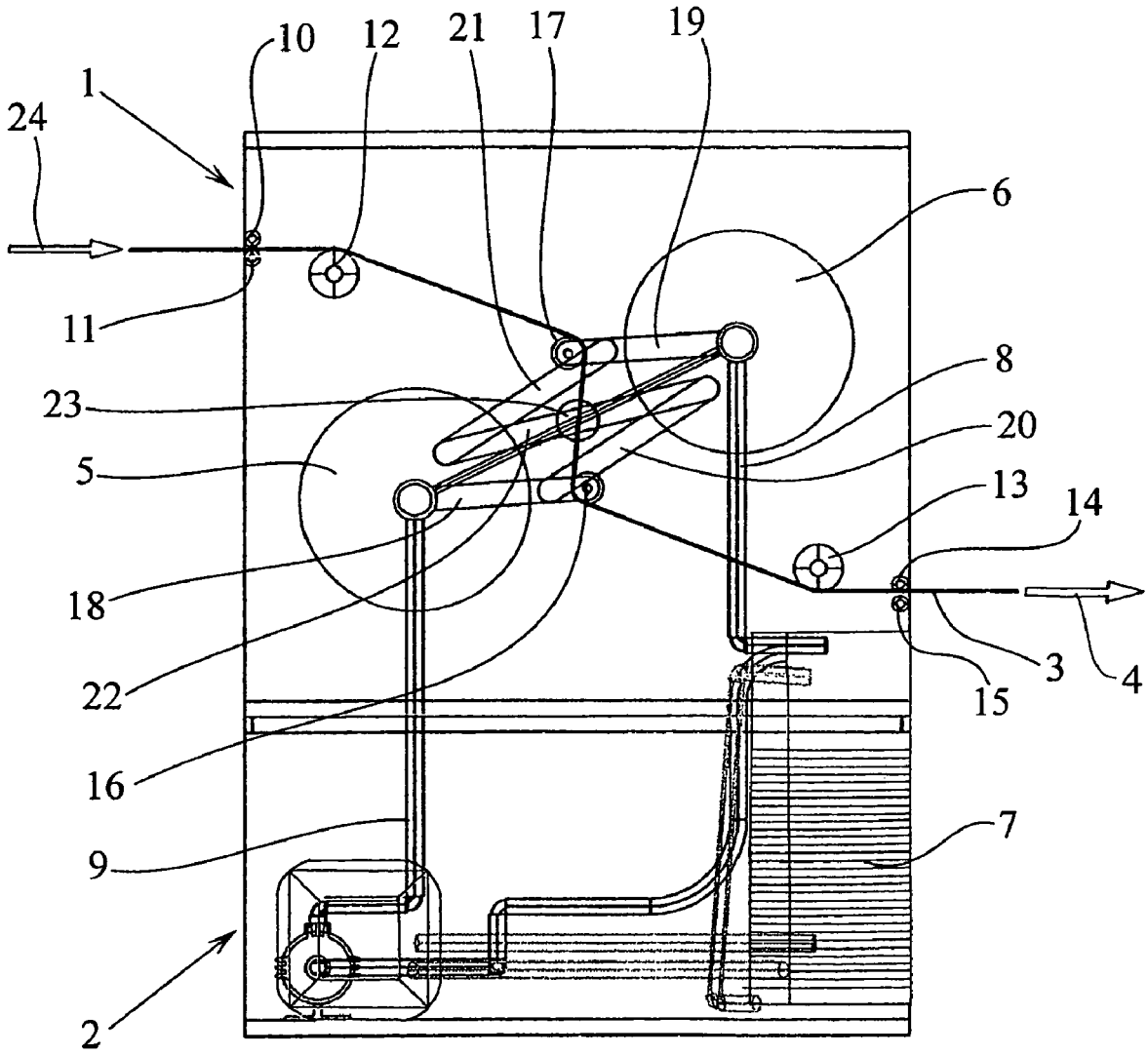
Figure 5:
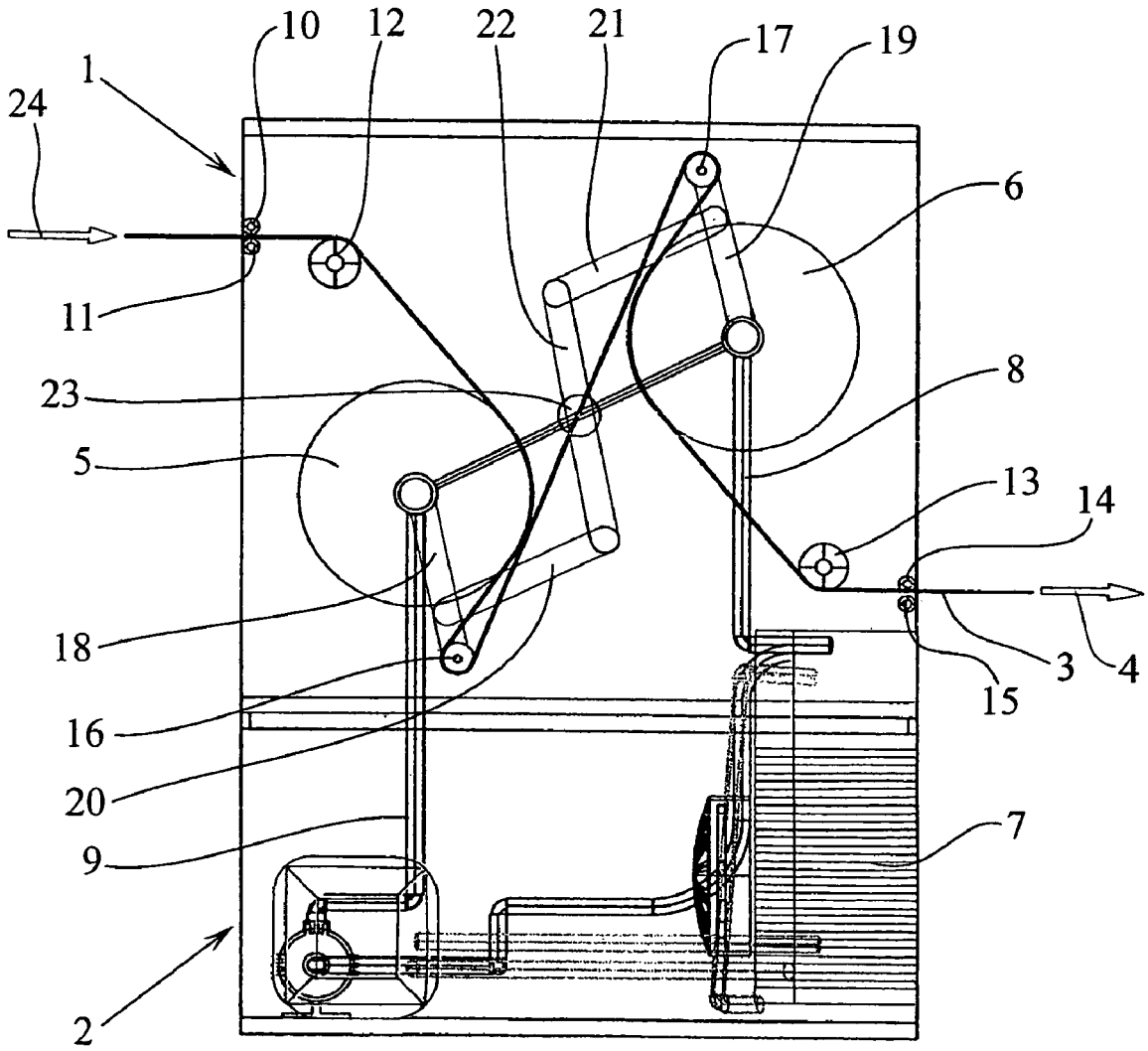

FIGS. 4 and 5 also illustrate diagrammatic cross-sections relating to the operation of the machine.

Figure 6:
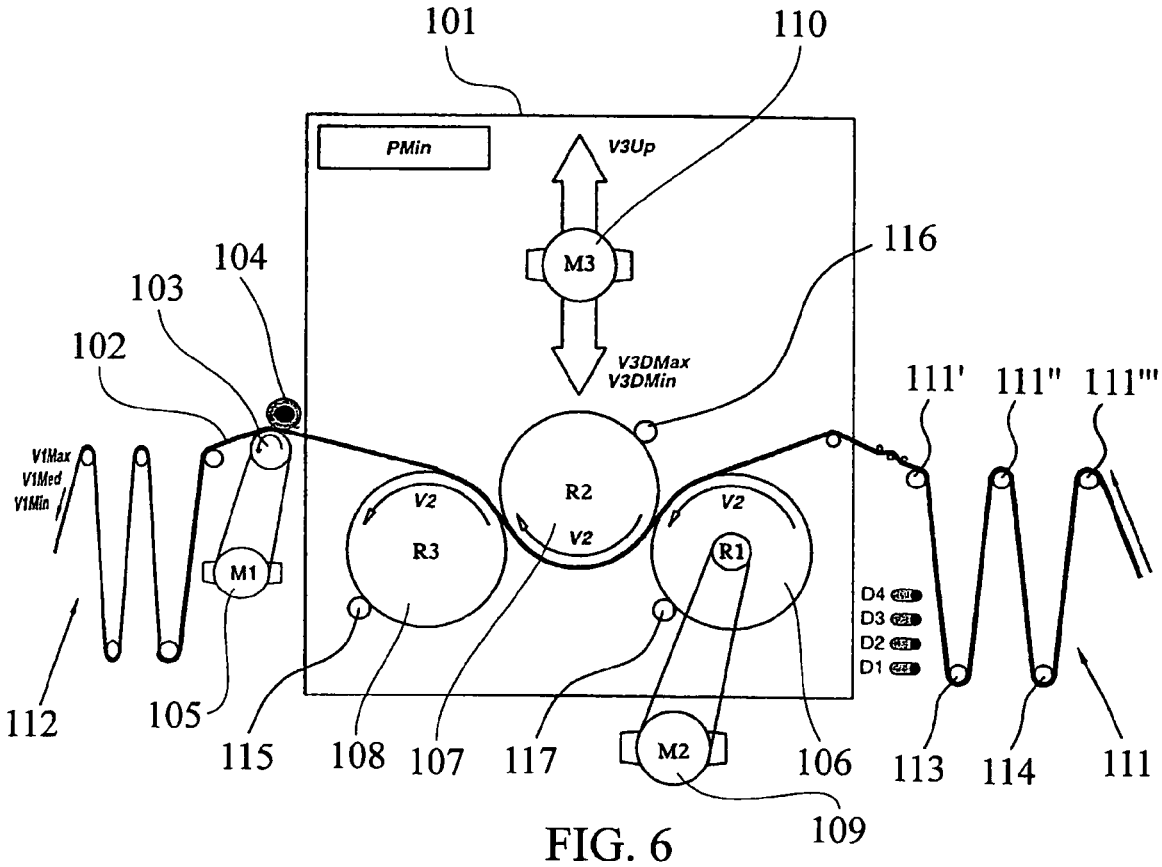
Figure 7:
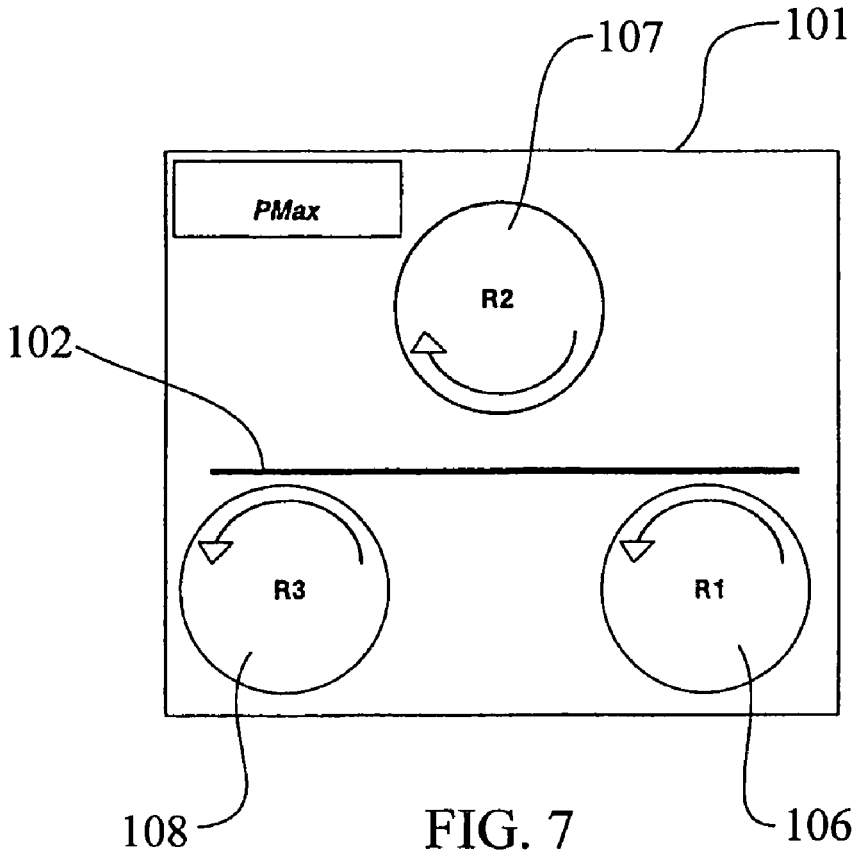
Figure 8:
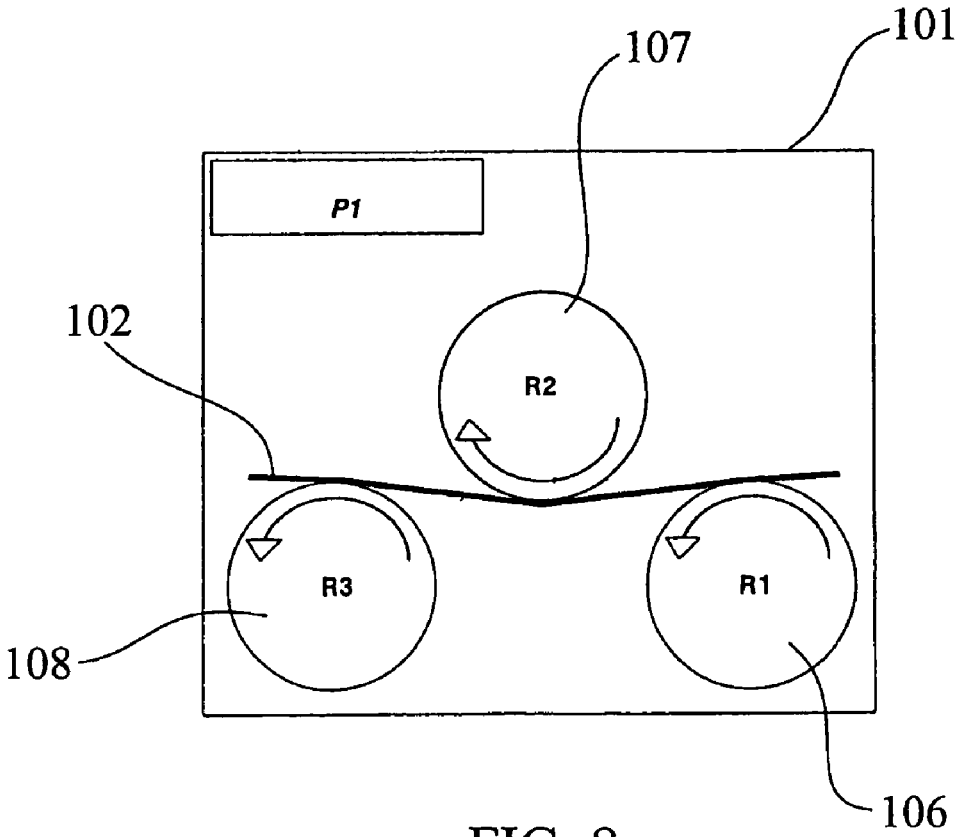
Figure 9:
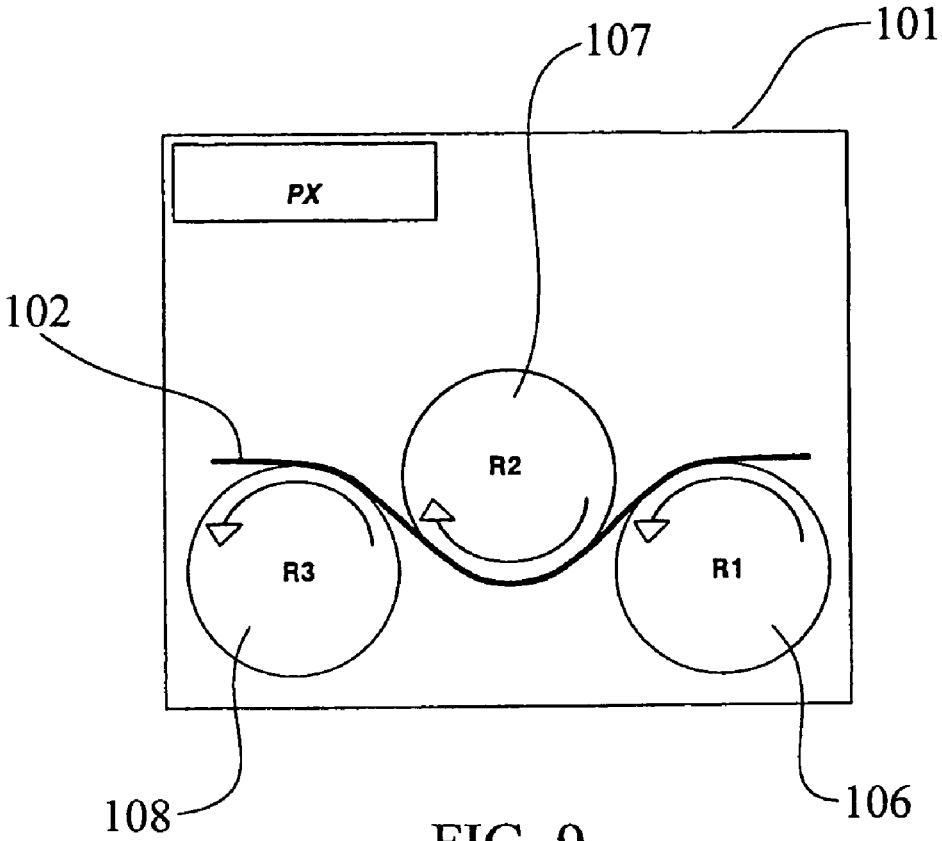
Figure 10:
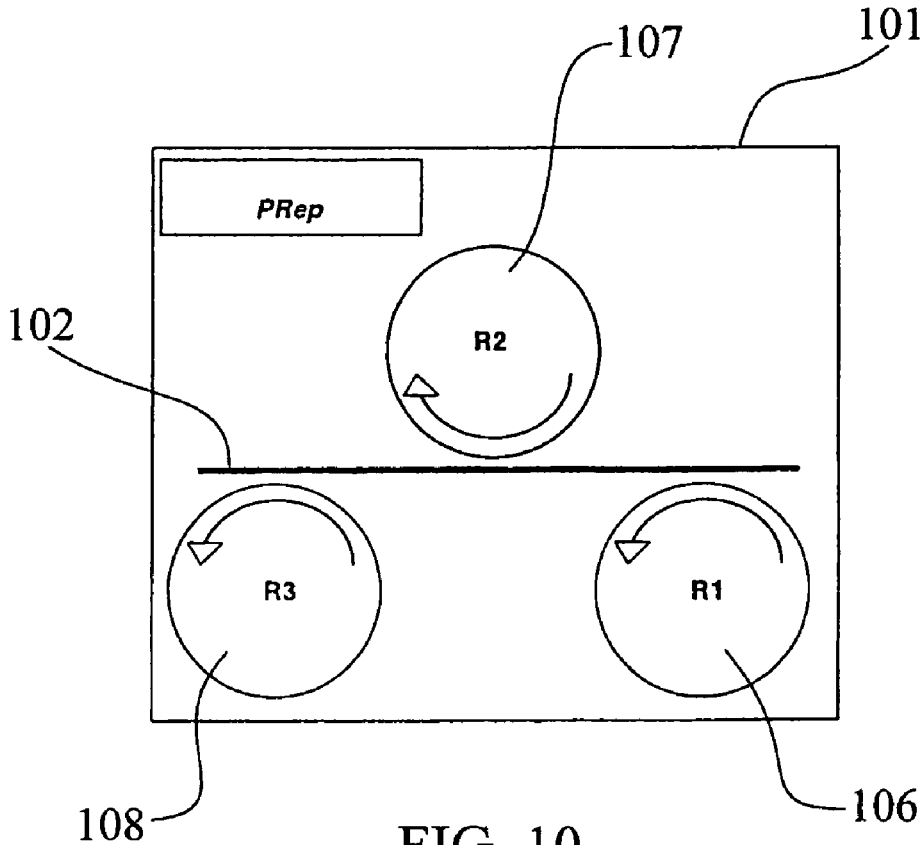

FIG. 6 shows diagrammatically the set of components concerned in a version with three rollers.

FIGS. 7, 8, 9 and 10 show diagrammatic views of each relative position of the fixed and movable rollers of the invention.

FIGS. 11, 12, 13 and 14 show different illustrations of variants of the set of rollers of FIGS. 6 to 10.

Figure 15:
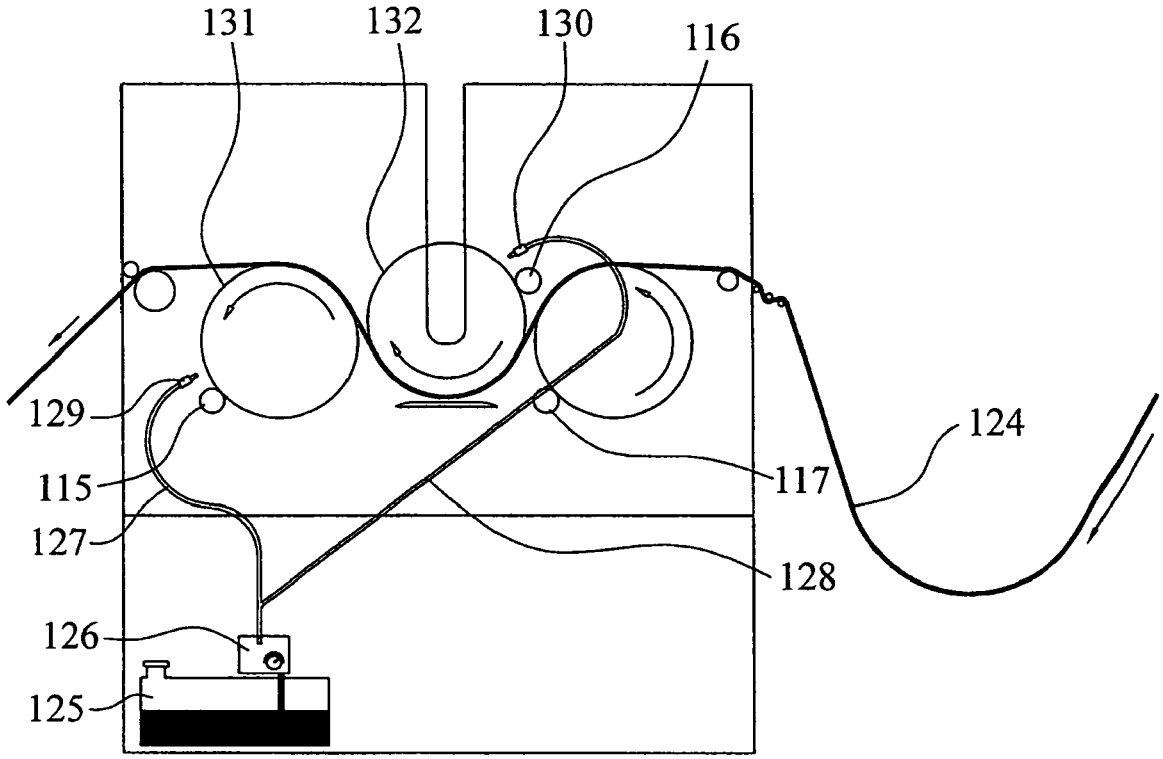
Figure 16:
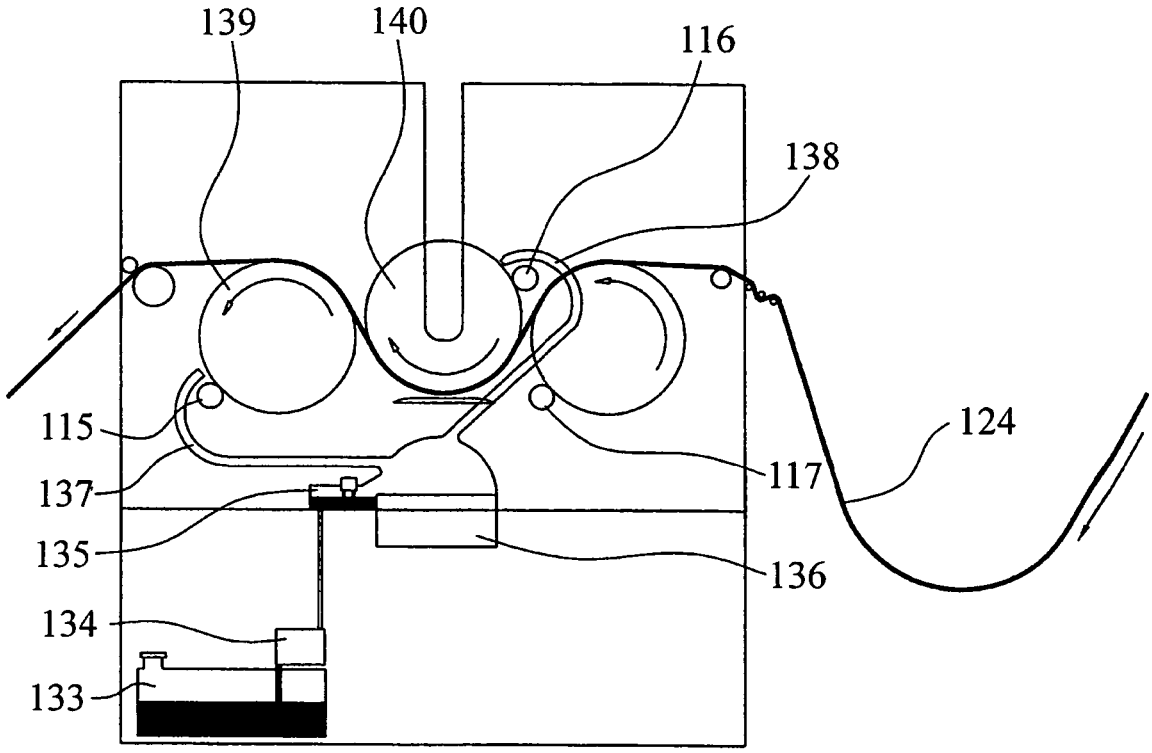

FIGS. 15 and 16 each show variants of means to increase the moistening of the paper sheeting.

Figure 17:
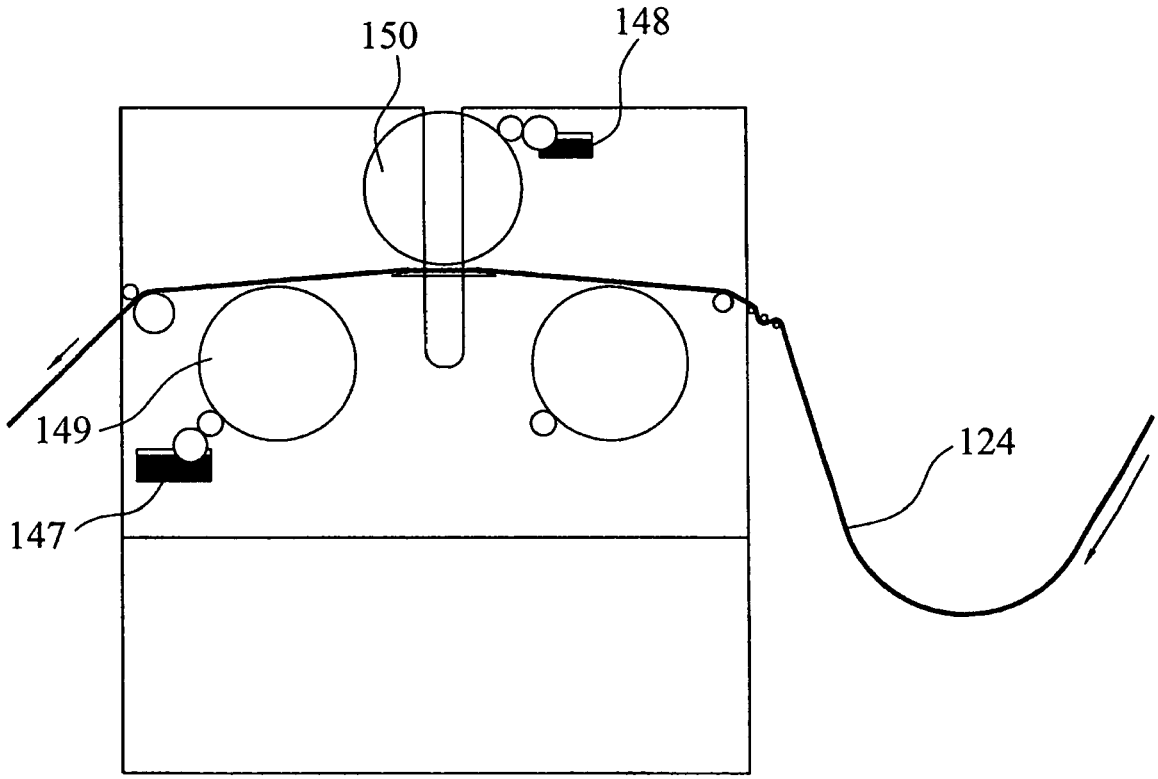
Figure 18:
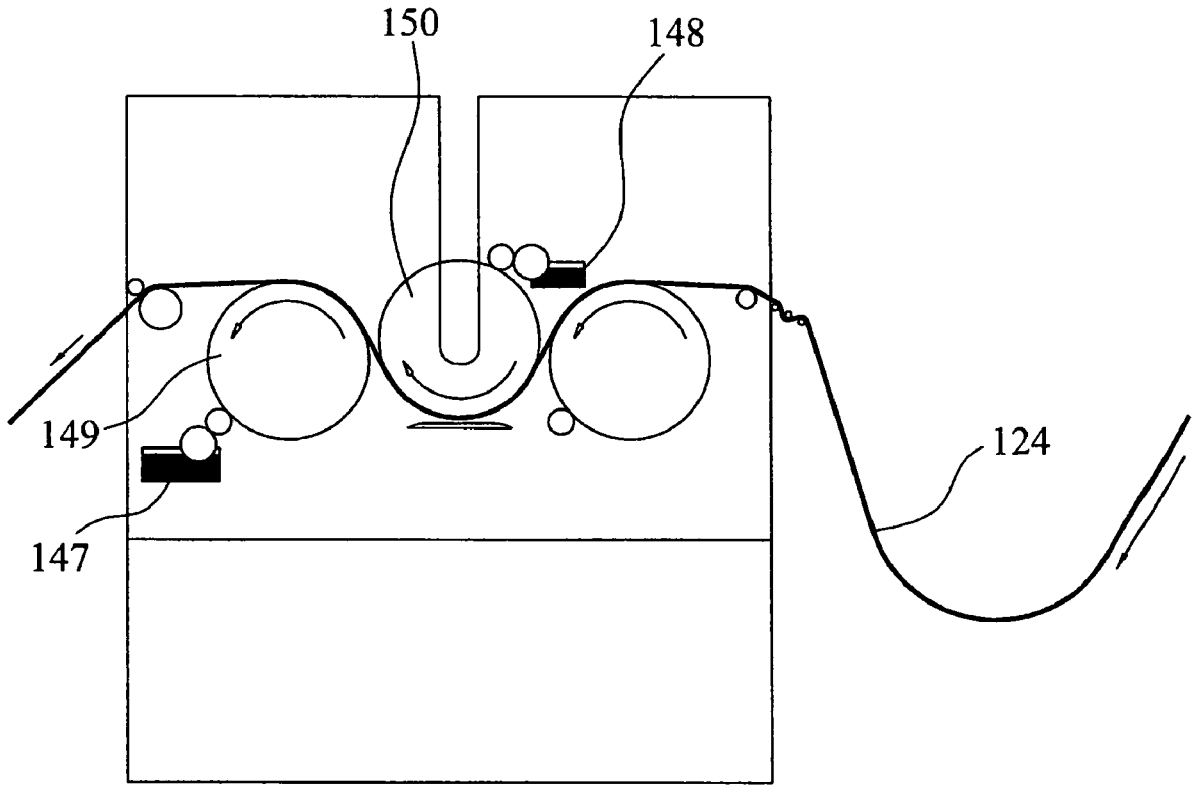

FIGS. 17 and 18 each show variants of moistening.

Figure 19:
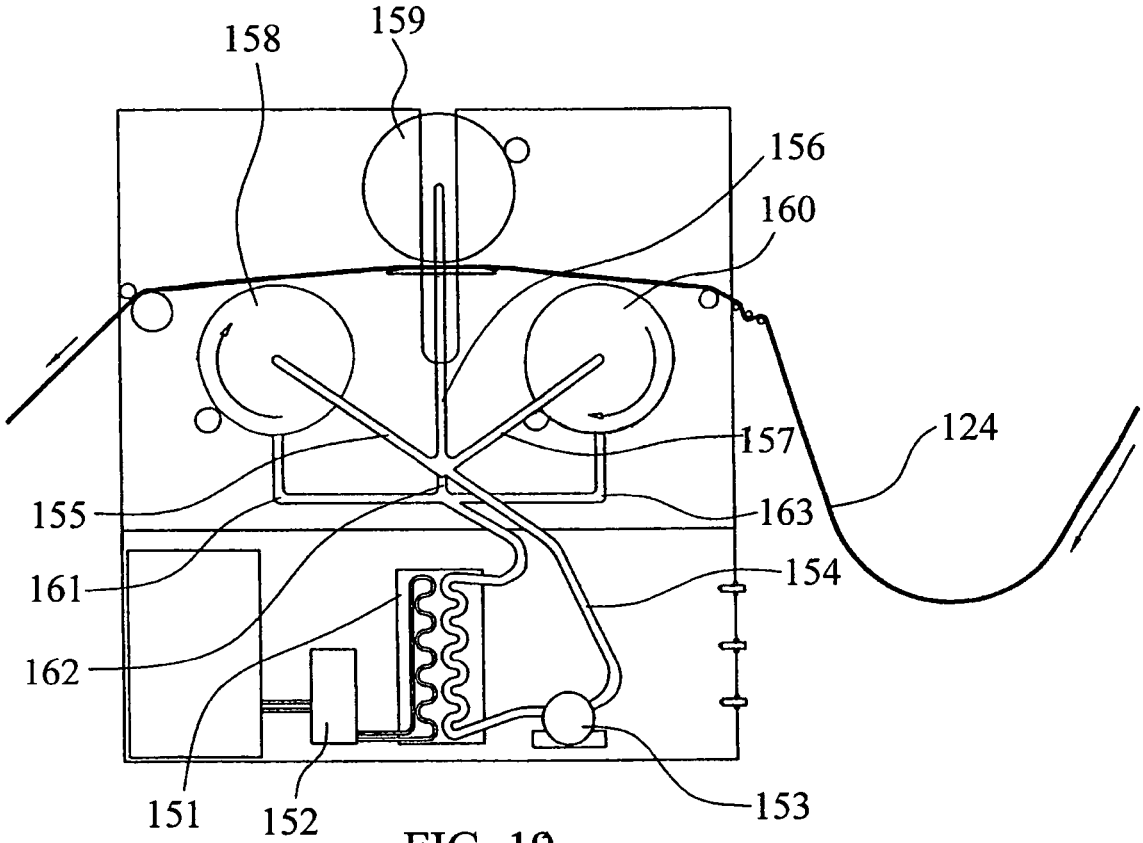

FIG. 19 shows diagrammatically the arrangement of an improved refrigeration system.

In accordance with said figures, the machine according to the invention comprises a casing 1 for the remoistening drums that also comprises a conventional refrigeration unit 2, allowing conditioning of a continuous web of paper 3 emerging from the machine, in the direction of the vector designated by the number 4, in remoistening conditions.

To achieve said remoistening, the machine has a variable number of drums that in the case illustrated have been indicated with the numbers 5 and 6, said drums being hollow and produced in a metallic material, that is a good heat conductor, and equipped inside with refrigeration means that in the figure have been illustrated diagrammatically by a refrigeration unit 7 preferably arranged in a base of the machine so that it can be fed by means of coolant using a system of tubes illustrated by the inlet tube 8 to the drum 6 and the outlet tube 9 from the drum 5, there being also a connection tube between the drums 5 and 6 that has not been illustrated in the figures. By means of this arrangement and given that the ambient air surrounding the machine unit, including the drums 5 and 6, has a determined humidity, a deposit of condensation droplets occurs on the outside surface of said drums 5 and 6. The process according to the invention therefore consists of applying the web of paper 3 as it passes on the outer surface of said drums, in zones of variable tangency, to achieve regular and stable remoistening of the paper.

Accordingly, the process will comprise detection of the moisture of the paper both on entering and on leaving the machine, the difference between the entry moisture and the moisture ideally required for the paper to behave correctly being the information that will determine the adjustment of the remoistening conditions of the process, varying the determining parameters to suit. These parameters fundamentally are refrigeration conditions that are more or less intense inside the drums and the expanse of the sector or area of coincidence of the paper on the outer surface of said drums. Measurement of the moisture of the paper on emerging from the process and corresponding apparatus will also allow it to be compared with the theoretical value in order to introduce corrections to the operation of the machine and adjust the process to the ideal conditions.

Control of the parameters mentioned is performed by the appropriate sensors of moisture, temperature and ambient humidity, etc. that, once introduced in an electronic process unit provided with the relevant software, will allow control signals to be emitted to vary the values of the aforementioned parameters.

Apart from the internally refrigerated drums that receive the continuous web of paper on their exterior and that, in the specific case illustrated, are two in number, the apparatus that forms part of the present invention comprises a series of rollers guiding the paper at the entry to the machine that has been illustrated by the vector 9, for example the pair of rollers 10 and 11 and another guide roller 12 to which are added at the exit another upper roller 13 and another pair of rollers 14 and 15. It should be understood that they have been illustrated simply as a representative example, but that both the number and the position of said rollers may vary within wide limits.

According to the process and machine of the present invention, remoistening of the continuous web of paper will be controlled fundamentally by the tangency zone of the paper 3 on the drums 5 and 6. The apparatus according to the present invention therefore has a device to vary the area of coincidence between the web of paper 3 and the outer surface of said drums. In the particular case illustrated the aforementioned device comprises guide rollers 16 and 17 mounted on articulated parallelograms formed by the arms 18 and 19 in a radial arrangement on the bushes of the axes of the drums 5 and 6 and other arms 20 and 21 situated at an intermediate point of the arms 18 and 19 and also at the ends of the other intermediate arm 22 rotating round an intermediate axis 23. With this arrangement the zone of tangency of the continuous web of paper on the drums 5 and 6 can be varied from the position illustrated in FIG. 4 in which the web of paper 3 makes no contact at all with the drums 5 and 6 to the position illustrated in FIG. 5 in which said web of paper 3 coincides over a wide surface sector of said drums 5 and 6. As is evident, the arrangement illustrated in FIG. 4 will correspond to situations when the machine is stopped, for example, prior to the start of operation of the machine or when it is stopped for some reason connected with the operation of the set of machines for printing, cutting, classification, etc.

Referring to FIG. 6, the conditioning chamber designated by the number 101 is traversed by the paper sheeting 102, which is introduced by means of a traction roller 103 on which a support roller 104 acts, actuation being carried out by means of a motor 105 with a single rotation direction and three speeds, a maximum speed (v1max), an intermediate speed (v1med) and a minimum speed (v1min). Incorporated inside the chamber 101 are the end refrigeration rollers 106 and 108, which are actuated by means of a motor 109. The roller 107 is also a cooler and can be moved vertically by means of the motor 110, with two speeds downwards (v3dmax, v3dmin) and one speed upwards (v3up).

The axes of the cooling rollers 106 and 108 are fixed in space and the rotation direction is the same for both. The roller 107 turns in the opposite direction to the rollers 106 and 108.

A system of loop detectors, designated by the initials D1, D2, D3 and D4, allows loops to be detected optically as follows:

D1 optically detects the lower loop for the presence of too much paper;

D2 optically detects the middle loop for the presence of enough paper;

D3 optically detects the middle loop for too little paper and;

the detector D4 optically detects the upper loop for the presence of the absolute minimum amount of paper.

A system of timers can delay the start of operation of the motors and the waiting time when the print signal changes from on to off.

FIG. 6 shows the two entry 111 and exit 112 buffer systems that comprise sets of fixed rollers 111', 111", 111'" and floating or movable rollers such as 113 and 114 that in the case of the system 112 have not been numbered for greater clarity, and that has the same number of rollers as the entry system 111. This makes it possible to combine the machine with other peripheral machines, achieving greater integration with existing machines on the market, providing better operational stability at high speed, in other words, for speeds of more than 60/70 m/minute, with a longer paper run between the printer and the machine to reduce the temperature of the paper at high speed, a situation in which the temperature is highest.

In the same figure tangency regulating rollers 115, 116 and 117 have been shown for the machine rollers, designed to regulate the layer of moisture on the surface of said rollers before contact with the paper sheeting.

Figure 11:
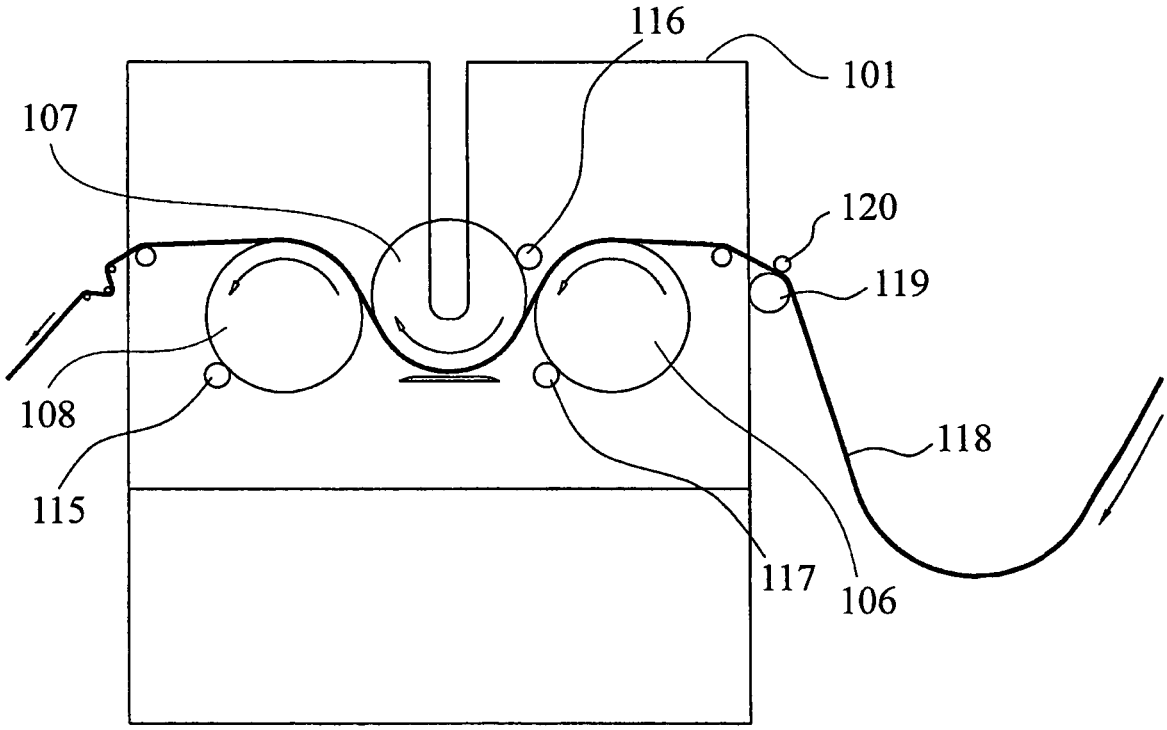

FIG. 11 shows an arrangement in which the paper sheeting 118 is subjected to traction from the entry side, the rollers 119 and 120 thereof having been illustrated diagrammatically.

Figure 12:
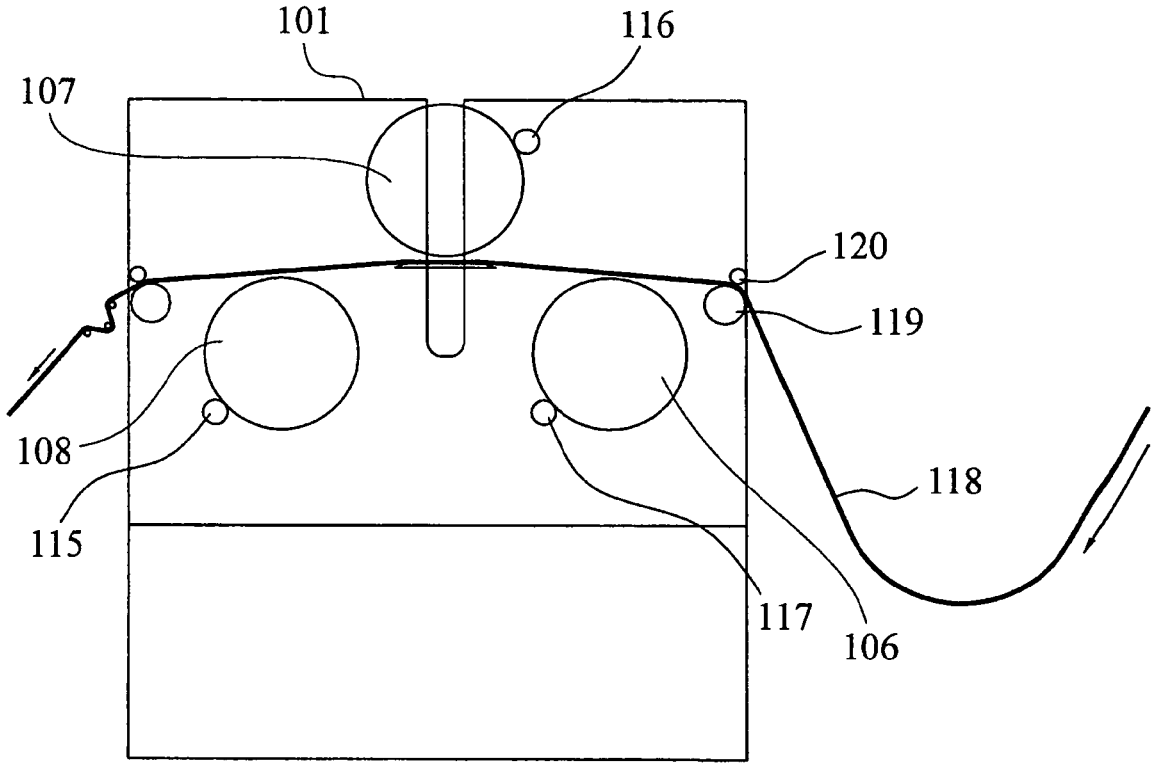

The illustration of FIG. 12 shows the same arrangement of rollers as in FIG. 11 in the position when the machine is stopped.

Figure 13:
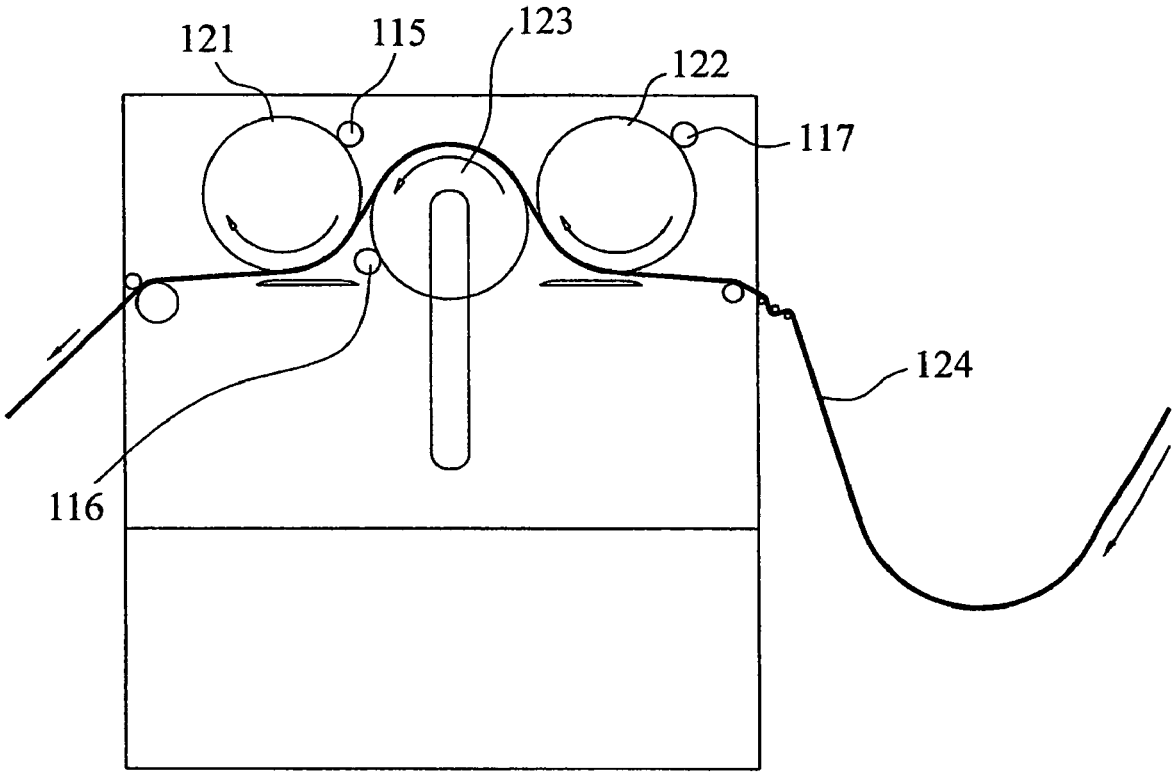
Figure 14:
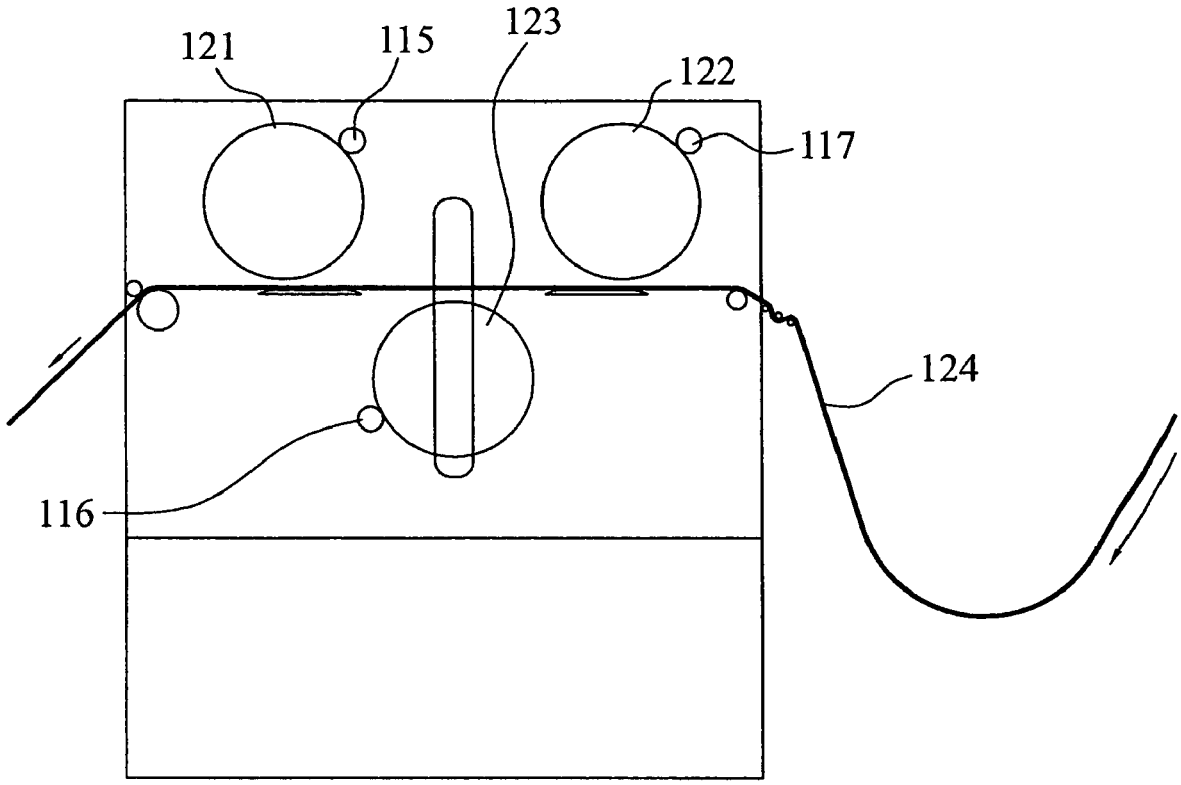

FIGS. 13 and 14 show the reverse assembly arrangement of the main rollers, the side rollers 121 and 122 having been illustrated in the upper part and the vertically movable roller 123 that will adopt the arrangement shown in FIG. 13 in the operating position and the arrangement in FIG. 14 in the rest position. In both cases the sheet 124 can be seen, which has been illustrated by the exit driving device, and provision can clearly be made for entry driving devices as shown in the previous figures FIG. 15 shows a variant for moistening the rollers that comprises a central liquid storage tank 125 from which an actuation system 126 supplies fine jets of atomised water through the tubes 127 and 128 towards the exit nozzles 129 and 130 directed, for example, at the rollers 131 and 132 with the aim of achieving a more regular layer of moisture on the surface of said rollers before contact with the paper.

FIG. 16 shows a moistening arrangement using a steam circuit with the liquid storage tank 133 from which the water is driven by the actuator 134 towards the electric vaporiser 135, in such a way that the saturated or almost saturated water vapour is driven by a fan 136 towards the tubes 137 and 138 designed to spray the vapour onto the surface of the rollers 139 and 140 producing a more uniform layer of water on said rollers.

FIGS. 17 and 18 show other variants of moistening by tangency in which tanks 147 and 148 can be seen for each of the rollers 149 and 150 with the respective sets of applicator rollers that have not been numbered, for greater clarity.

In FIG. 18 the arrangement of the moistening unit 148 is shown in the top part of the travel of the central roller 150.

FIG. 19 shows an embodiment with refrigeration of the inner part of all the rollers of the machine, the heat exchanger unit 151, the compressor 152, the pump 153 with the set of feed tubes 154, 155, 156 and 157 to the rollers 158, 159 and 160 having been illustrated in the cooling equipment. The return tubes have been designated by the numerals 161, 162 and 163, returning to the heat exchanger 151.

Refrigeration of the rollers can therefore be carried in series arrangement, in other words, sequentially or alternatively in a parallel arrangement.

It should also be noted that the addition of moisture to the concave part of the piece of paper is designed to correct unevenness caused by the paper unwinding, moistening only or principally the face that is concave, which allows offset paper to be used, which is more economical, by about 15/20%, than higher quality or laser paper, currently used for economic reasons.

In FIGS. 7 to 10, the three rollers have been illustrated respectively in the maximum position (pmax), the contact position (p1) and the work position (px) with a variable zone of contact with the refrigeration rollers and in particular the roller R2 and the rest position in which the intermediate roller is just above the passing paper sheeting.

By means of the improvements of the present invention the operational effectiveness of the printed paper conditioning apparatus is substantially improved, giving the system great simplicity of construction and great ease of regulation.

The process according to the present invention will admit variants that may be introduced by persons skilled in the art after gaining knowledge of the subject matter of the present invention, as emerges from the description and claims.

Similarly, the apparatus according to the present invention has only the characteristics of an illustrative example of the way in which the process according to the invention can be implemented and will therefore admit wide variants within the scope covered by the accompanying claims.

The invention claimed is:

1. A machine for remoistening paper printed by means of digital systems, whether it is a web of paper or sheets of cut paper, comprising:

a plurality of hollow cylindrical drums, wherein the outer surfaces of the drums are subjected to moist air so as to produce a regular film of condensation droplets on the outer surfaces of the drums;

at least one refrigerating unit configured to refrigerate the interior of at least one of the drums;

at least one moisture detecting unit configured to detect the moisture of the paper and generate at least one moisture signal indicating the moisture of the paper; and a control unit configured to receive the at least one moisture signal and control the at least one refrigerating unit in such a way as to bring an exit moisture closer to a desired value.

2. The machine of claim 1, further comprising a unitary body that includes the refrigeration unit and the drums.

3. The machine of claim 1, further comprising at least one adjusting unit configured to adjust a surface area of the paper that comes into contact with the drums.

4. The machine of claim 3, wherein the plurality of hollow cylindrical drums includes:

at least one spatially fixed rotatable drum; and at least one moveable rotatable drum that can be moved vertically, wherein all of the rotatable drums have refrigeration units configured to provide variable degrees of refrigeration, and the printed paper is guided along the set of rotatable drums in such a way as to be able to adjust the zones of tangency, by way of the adjusting unit, in order to vary the intensity of the conditioning refrigeration.

5. The machine of claim 4, wherein there are two rotatable drums with fixed horizontal axes, rotating in the same direction, and one rotatable drum that can be moved vertically which is arranged in an intermediate position, above the two rotatable drums with fixed axes and with the ability to move vertically up and down to adjust the surface area of paper that comes into contact with the rotatable drums.

6. The machine of claim 4, further comprising an independent motor configured to drive the vertical movement of the moveable rotatable drum, with at least two upward speeds and at least one downward speed.

7. The machine of claim 4, wherein the paper is supplied to a conditioning chamber by an entry roller actuated by an independent motor with at least three different selectable speeds.

8. The machine of claim 4, further comprising four optical loop detectors, wherein a first optical loop detector is configured to detect the presence of too much paper on a lower loop of the machine, a second optical loop detector is configured to detect the presence of enough paper on a middle loop of the machine, a third optical loop detector is configured to detect the presence of too little paper on the middle loops and a fourth optical loop detector is configured to detect the presence of an absolute minimum amount of paper on an upper loop of the machine.

9. The machine of claim 4, further comprising sets of compensation rollers that are arranged at both the entry and the exit of the machine, each set of compensation rollers including a set of fixed rollers and a set of free rollers that can move up and down to stabilise the movement of the sheet of paper at high speed, in order to reduce the temperature at high speeds.

10. The machine of claim 4, further comprising moisture regulating rollers configured to regulate the films of moisture on the rotatable drums, wherein the moisture regulating rollers are arranged so as to touch one or more of the rotatable drums before the paper sheeting makes contact with the rotatable drums.

11. Machine for remoistening paper printed by means of digital systems, whether it is a web of paper or sheets of cut paper, according to claim 4, characterised in that a unit is provided to spray jets of atomised water over one or more of the main rollers of the machine, each comprising a nozzle connected by independent tubes to a centralised system for distributing atomised water.

12. Machine for remoistening paper printed by means of digital systems, whether it is a web of paper or sheets of cut paper, according to claim 4, characterised in that a system is provided for adding moisture to the main rollers by spraying saturated water vapour coming from the independent tubes of a device for vaporising and spraying vapour incorporated in the machine itself.

13. Machine for remoistening paper printed by means of digital systems, whether it is a web of paper or sheets of cut paper, according to claim 4, characterised in that components are provided to distribute a film of water over the main rollers by means of small tanks of water and systems of tangential rollers.

14. Machine for remoistening paper printed by means of digital systems, whether it is a web of paper or sheets of cut paper, according to claim 4, characterised in that a common refrigeration system is provided for the main rollers of the machine, comprising branched circuits of low temperature fluid from the refrigeration apparatus incorporated in the machine and other circuits also branched for returning the fluid to the refrigeration unit after cooling the main rollers.

15. The machine of claim 4, wherein the printed paper has at least one concave face and at least one convex face, and the printed paper is guided along the set of rollers so as to directly moisten the at least one concave face.

16. The machine of claim 3, wherein the control unit is further configured to control the at least one adjusting unit in such a way as to bring the exit moisture closer to a desired value.

17. The machine of claim 1, wherein the at least one moisture detecting unit comprises an entry moisture detecting unit configured to detect the moisture of the paper before it makes contact with any of the hollow cylindrical drums and generate at least one entry moisture signal.

18. The machine of claim 17, wherein the at least one moisture detecting unit further comprises an exit moisture detecting unit configured to detect the moisture of the paper after it has passed through the plurality of hollow cylindrical drums and generate at least one exit moisture signal.

19. The machine of claim 18, wherein the control unit controls the at least one refrigerating unit by generating at least one control signal which is determined by comparing at least one of the at least one entry moisture signal or the at least one exit moisture signal with the desired value.

* * * * *